United States Patent [19]

Berg

[11] Patent Number: 4,789,765

[45] Date of Patent: Dec. 6, 1988

[54] SWITCH DEVICE

[75] Inventor: William E. Berg, Portland, Oreg.

[73] Assignee: Tektronix, Inc., Beaverton, Oreg.

[21] Appl. No.: 88,545

[22] Filed: Aug. 20, 1987

Related U.S. Application Data

[63] Continuation of Ser. No. 854,442, Apr. 21, 1986, abandoned.

[51] Int. Cl.[4] ..... H01H 1/24

[52] U.S. Cl. ..... 200/245; 200/275; 200/250; 200/153 L; 200/159 R

[58] Field of Search ..... 200/245, 275, 290, 250, 200/153 L, 153 LB, 153 LA, 159 R, 340, 159 B, 239, 243, 292

[56] References Cited

U.S. PATENT DOCUMENTS

| | | | |
|---|---|---|---|
| 2,559,112 | 7/1951 | Christensen | 200/159 R |
| 3,900,711 | 8/1975 | Holland | 200/275 |
| 4,366,355 | 12/1982 | Oelsch | 200/159 B |
| 4,454,562 | 6/1984 | Bush et al. | 200/340 |
| 4,551,595 | 11/1985 | Koenig et al. | 200/159 B |
| 4,596,912 | 6/1986 | Hattori | 200/340 |

*Primary Examiner*—Henry J. Recla
*Assistant Examiner*—Linda J. Sholl
*Attorney, Agent, or Firm*—John Smith-Hill; William K. Bucher

[57] ABSTRACT

A switch device comprises a resilient contact member and a support member carrying the contact member. The support member is movable between a first position in which the contact member is in electrically-conductive contact with two conductor elements that are stationary relative to each other and a second position in which the contact member is spaced from at least one of the conductor elements. A resilient member urges the support member in the direction from the second position towards the first position.

6 Claims, 3 Drawing Sheets

SWITCH DEVICE

This is a continuation of application Ser. No. 854,442, filed Apr. 21, 1986, and now abandoned.

This invention relates to a switch device.

BACKGROUND OF THE INVENTION

In various types of electronic instruments, such as oscilloscopes and spectrum analyzers, it is desirable that high frequency signals be connected selectively between conductors without substantial reflection or attenuation of the signal. Several kinds of mechanically-actuated switches have been proposed for this purpose. For example, U.S. Pat. No. 3,719,788 issued Mar. 6, 1973 discloses a cam-actuated switch comprising a metal contact member carried by a cam follower that is mounted in cantilever fashion to a circuit board. A rotatable cam engages the cam follower, and during the dwell of the cam the metal contact member is pressed into contact with two conductor runs of the circuit board and establishes electrical connection between those conductor runs. In order for the connection provided by this type of switch to have consistent electrical characteristics, it is necessary that the contact force between the metal contact member and the conductor runs be the same each time the switch is actuated by engagement of the cam follower by the cam dwell. In order to provide consistent contact force, precision bearings are required for the cam shaft. If the same cam shaft is used to actuate several switches the force is consistent from switch to switch only if the cam itself is a precision part and the surface of the circuit board is flat within quite small tolerances and is parallel to the axis of rotation of the cam. Moreover, because the cam follower is cantilever-mounted, it is difficult to achieve and maintain proper alignment of the metal contact member and the conductor runs.

Another type of switch having good high-frequency characteristics is shown in U.S. Pat. No. 4,150,420 issued Apr. 17, 1979. The switch shown in that patent is subject to much the same disadvantages as the switch of U.S. Pat. No. 3,719,788.

SUMMARY OF THE INVENTION

A preferred switch device embodying the invention comprises a resilient contact member and a support member carrying the contact member. The support member is movable between a first position in which the contact member is in electrically-conductive contact with two conductor elements that are stationary relative to each other and a second position in which the contact member is spaced from at least one of the conductor elements. A resilient member urges the support member in the direction from the second position towards the first position.

The present invention may be used to provide a switch that is suitable for transmitting high frequency signals over a gap between two transmission lines. In the preferred embodiment of the invention, the contact member is small and therefore introduces only minimal inductance into the signal path when the support member is in its first position. Accurate alignment of the contact member with the stationary conductor elements is achieved.

BRIEF DESCRIPTION OF THE DRAWINGS

For a better understanding of the invention, and to show how the same may be carried into affect, reference will now be made, by way of example, to the accompanying drawings in which.

DETAILED DESCRIPTION

Figure 1:
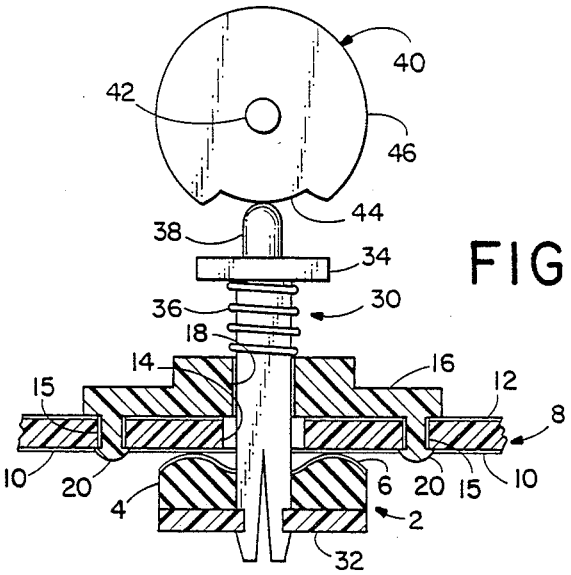
FIG. 1 is a partial sectional view of a switch device embodying the present invention.
Figure 2:
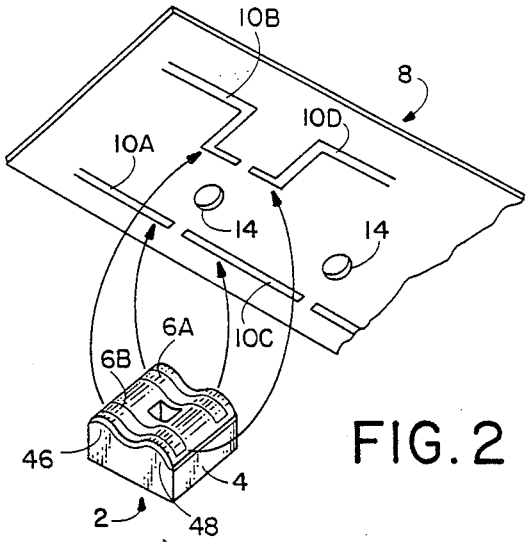
FIG. 2 is a perspective view of the lower surface of the circuit board to which the switch is mounted, with the switch removed.
Figure 3A:
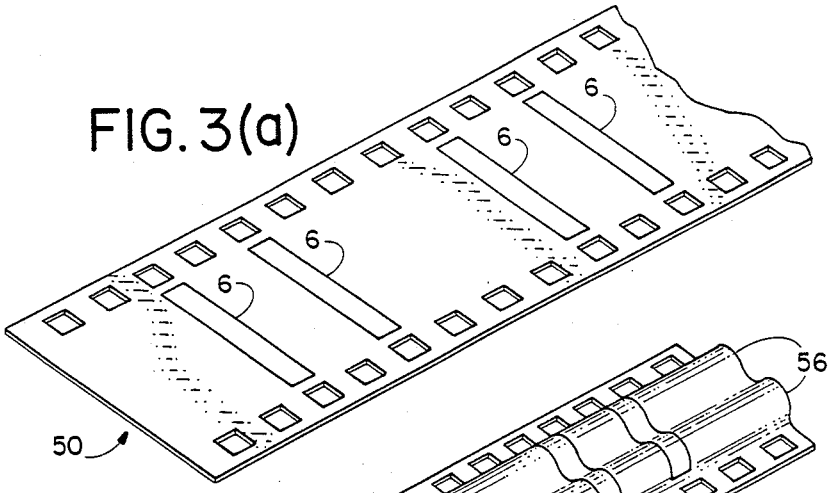
FIG. 3 illustrates fabrication of a component of the FIG. 1 switch.
Figure 3B:
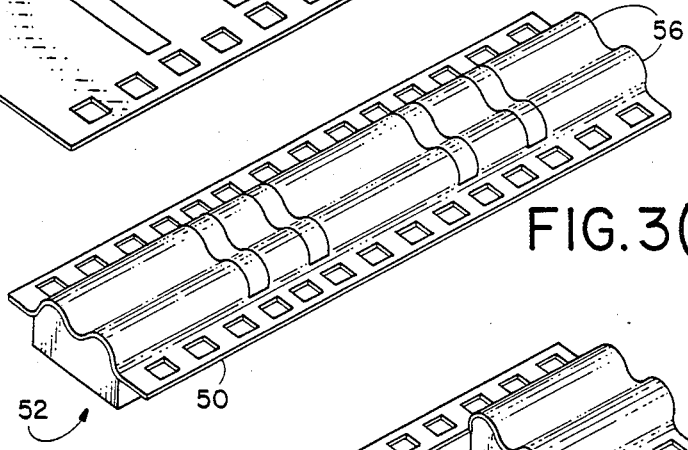
Figure 3C:
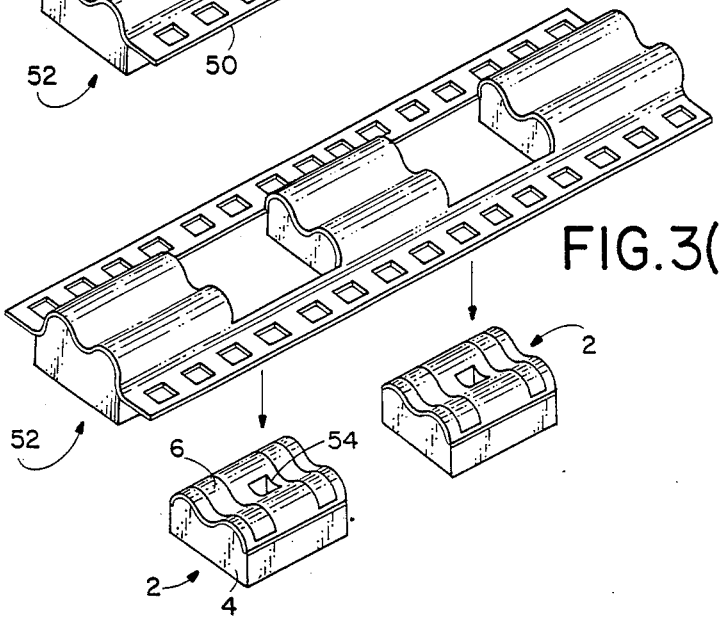

A contact member 2 comprises a body of elastomer material 4 having contact element 6A and 6B of metal adhered thereto. A circuit board 8 has conductor runs 10A, . . . 10D at its lower surface and a ground plane 12 on its upper surface. The dimensions and properties of the circuit board 8, the conductors runs 10 and the ground plane 12 are such that the conductor runs 10 and the ground plane 12 form transmission lines. The circuit board is formed with an opening 14. A guide block 16 of self-lubricating plastic, e.g. nylon or the material sold under the trademark Delrin, is formed with a square-section opening 18 and has pins 20 projecting downwardly from its lower surface. The pins 20 are fitted in holes 15 in the circuit board. The positions of the pins 20 relative to the opening 18 and of the holes relative to the opening 14 are such that the opening 18 of the guide block is aligned with the opening 14 of the circuit board. The guide block 18 is attached to the circuit board 8 by swaging the pins 20. The contact member 2 is attached to the lower end of a square-section support member or plunger 30 that extends upwardly through the openings 14 and 18 in the circuit board 8 and the guide block 16. A retainer plate 32 is secured to the plunger 30 at its lower end. The plunger 30 is made of self-lubricating plastic and has an enlarged flange 34 at its upper end, and a spring 36 is fitted on the plunger and is captive between the flange 34 and the upper surface of the guide block 16. The spring thus urges the plunger 30 upwards, drawing the contact member 2 into contact with the underside of the circuit board 8. When the contact member 2 contacts the circuit board 8, the contact element 6A establishes electrically conductive contact between the conductor runs 10A and 10C and the contact elements 6B establishes electrically conductive contact between the conductor runs 10B and 10D.

Above the flange 34, the plunger 30 has a protuberance 38 that engages the surface of a cam 40 as a cam follower. The cam 40 is mounted to rotate about a shaft 42, and has a peripheral depression 44. When the protuberance 38 engages the dwell 46 of the cam, the plunger 30 is forced downwards and the contact member 2 is spaced from the underside of the circuit board, whereas when the protuberance 38 enters the depression 44 the plunger is free to move upwards and the contact member is held against the lower surface of the circuit board by a force of which the magnitude depends upon the spring 36 and is independent of the cam 40.

Figure 4:
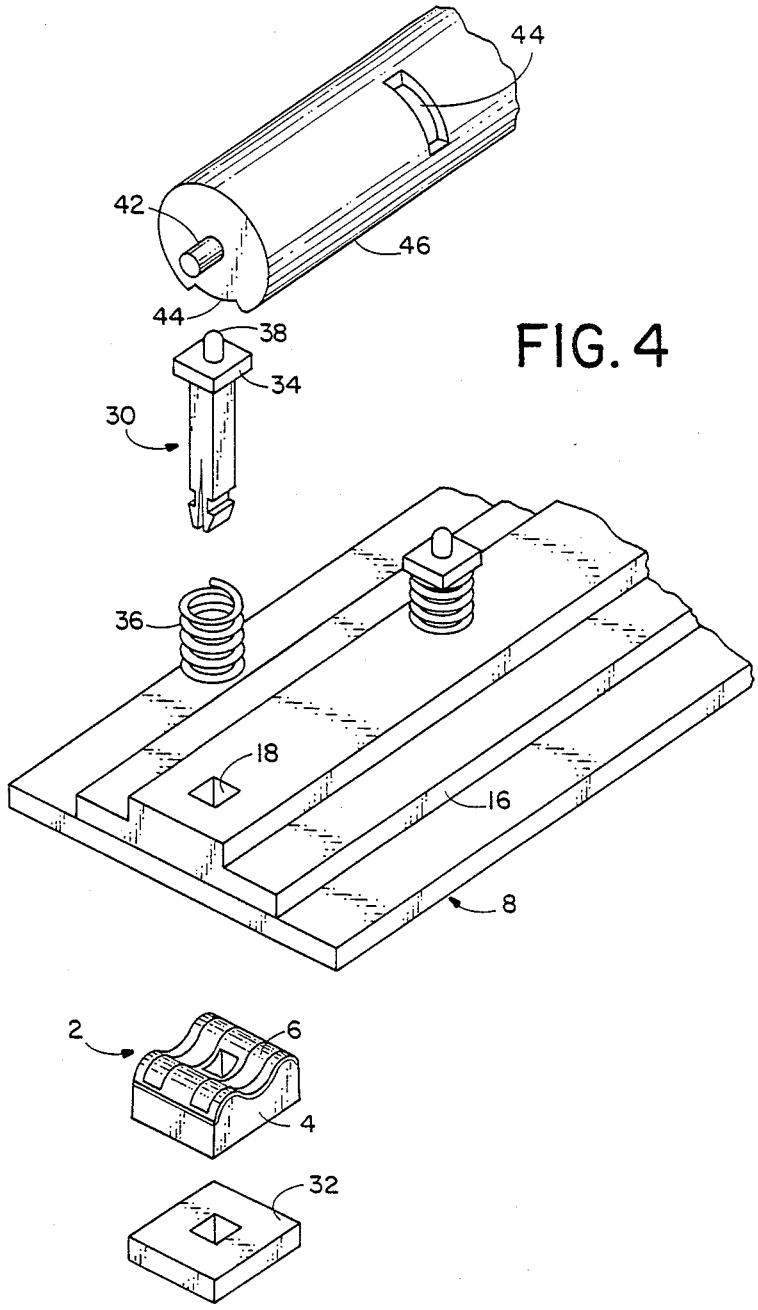
FIG. 4 is a partially-exploded perspective view illustrating the manner in which the FIG. 1 switch device is assembled.

The contact member 2 is made by techniques similar to those disclosed in U.S. Pat. No. 4,150,420. The contact elements 6 are formed on a 35 mm polyimide tape 50. For example, the tape 50 may have a surface coating of copper that is photoprocessed and etched to define strips of copper in the desired positions of the contact elements 6, and gold may then be deposited electrolessly on the strips of copper to form the finished contact elements. The tape 50 is placed in a molding cavity with the upper surface of the tape (the surface bearing the contact elements 6) towards the exterior of the cavity. The die that defines the molding cavity has a wall that is formed with two parallel grooves. An elastomer material is injected into the molding cavity behind the tape 50, and the pressure of the elastomer material forces the tape to conform to the contours of the grooved wall of the die. The elastomer material, which may be a silicone rubber, adheres strongly to the polyimide tape 50. Therefore, when the elastomer material cures there is formed an elongate body 52 comprising elastomer material and polyimide tape, with ridges 56 extending longitudinally of the body 52. Blocks, each having two contact elements, are then cut from the body 52 to form individual contact members 2, and a square through-hole 54 is formed in each block, between the two contact elements 6. The plunger 30 is inserted downwardly through the compression spring 36 and the holes 18 and 14 in the block 16 and the circuit board 8, and the contact member 2 is inserted over the projecting lower end of the plunger. As shown in FIG. 4, the plunger is formed with a slit at its lower end, and the two branches of the plunger, on opposite sides of the slit, are formed with recesses. When the retainer plate 32 is pushed onto the lower end of the plunger, the two branches are forced together and the plate 32 enters the recesses and permits the branches to snap apart. The retainer plate is thereby secured against longitudinal movement on the plunger. The contact member 2 is attached to the retainer plate 32 by means of adhesive material.

The positioning of the contact elements 6 relative to the conductor runs 10 is accurate and consistent, and the spring force urging the contact elements into engagement with the conductor runs is consistent and is independent of the cam, so long as the depression 44 is deep enough to receive the protuberance 38. The spring 36 is isolated from the conductor runs 10 by the ground plane, and the only conductive material on the same side of the ground plane as the conductor runs is the material of the contact elements. The contact member 2 has a ridge 46 projecting towards the runs 10A and 10B and a ridge 48 projecting towards the runs 10C and 10D. The ridged configuration of the contact member 2 ensures that when the plunger is forced upwards by the spring 36 and contact elements 6 are pressed into contact with the conductor runs 10, a wiping contact is achieved as the elastomer material is compressed.

It will be appreciated that the present invention is not restricted to the particular switch device that has been described and illustrated, and the variations may be made therein without departing from the scope of the invention. For example, it is not essential to use a cam in order to actuate the switch device, and, a solenoid, for example, may be used instead. Use of a solenoid has the advantage that it enables ready programming of the operation of the switch.

I claim:

1. A switch assembly comprising a circuit board having two conductor runs on one main surface thereof, and a switch device for providing electrical connection between said conductor runs, said switch device comprising:

a block of resilient dielectric material having one surface presented towards said one main surface of the circuit board and having at said one surface two ridges which project towards the conductor runs respectively, a strip of conductive material adhered to said one surface of the block and extending across said ridges, a support member carrying the block of resilient material, the support member being movable relative to the circuit board between a first position in which the block of resilient material is compressed and the strip of conductive material is held in electrically-conductive pressure contact with the conductor runs by the block of resilient material, and a second position in which the strip of conductive material is spaced from at least one of the conductor runs, and a resilient member urging the support member in the direction from its second position towards its first position.

2. A switch assembly according to claim 1, wherein the support member is movable rectilinearly in a direction substantially perpendicular to said one main surface between the first position and the second position.

3. A switch assembly according to claim 1, wherein the circuit board is formed with an opening and the support member comprises a plunger that extends through the opening, and wherein the said resilient member is disposed on the opposite side of the circuit board from the block of resilient material.

4. A switch assembly according to claim 3, wherein the circuit board has a ground plane on its main surface opposite said one main surface and the support member is made of dielectric material and said resilient member is a metallic spring.

5. A switch assembly according to claim 4, further comprising a device disposed at the same side of the circuit board as said resilient member for engaging the support member and urging it in the direction from its first position towards its second position.

6. A switch assembly according to claim 1, comprising a retainer plate carried by the support member and movable therewith, and wherein the block of resilient material is positioned between the circuit board and the retainer plate.

* * * * *